US008374910B1

(12) United States Patent
Spasokukotskiy

(10) Patent No.: US 8,374,910 B1
(45) Date of Patent: Feb. 12, 2013

(54) PARKING MANAGEMENT METHOD AND AUTOMATED PARKING SYSTEM FOR VEHICLES

(76) Inventor: Konstantyn Spasokukotskiy, Peachtree City, GA (US)

( * ) Notice: Subject to any disclaimer, the term of this patent is extended or adjusted under 35 U.S.C. 154(b) by 808 days.

(21) Appl. No.: 12/491,185

(22) Filed: Jun. 24, 2009

Related U.S. Application Data

(60) Provisional application No. 61/076,074, filed on Jun. 26, 2008.

(51) Int. Cl.
*G07B 15/00* (2006.01)

(52) U.S. Cl. ..... 705/13

(58) Field of Classification Search ..... 705/13
See application file for complete search history.

(56) References Cited

U.S. PATENT DOCUMENTS

| | | | | |
|---|---|---|---|---|
| 5,297,194 | A | 3/1994 | Hunt | |
| 5,432,508 | A | 7/1995 | Jackson | |
| 5,499,288 | A | 3/1996 | Hunt | |
| 5,740,050 | A | 4/1998 | Ward | |
| 5,897,616 | A | 4/1999 | Kanevsky | |
| 5,905,247 | A | 5/1999 | Ilen | |
| 5,940,481 | A * | 8/1999 | Zeitman | 705/13 |
| 6,026,367 | A | 2/2000 | Hjelmvik | |
| 6,161,090 | A | 12/2000 | Kanevsky | |
| 6,233,556 | B1 | 5/2001 | Teunen | |
| 6,243,029 | B1 * | 6/2001 | Tomer | 340/932.2 |
| 6,344,806 | B1 | 2/2002 | Katz | |
| RE37,822 | E | 8/2002 | Anthonyson | |
| 6,493,676 | B1 | 12/2002 | Levy | |
| 6,519,329 | B1 | 2/2003 | Hjelmvik | |
| 6,526,126 | B1 | 2/2003 | Morganstein | |
| 6,559,776 | B2 | 5/2003 | Katz | |
| 6,577,248 | B1 | 6/2003 | Hjelmvik | |
| 6,796,499 | B1 * | 9/2004 | Wang | 235/384 |
| 6,812,857 | B1 | 11/2004 | Kassab | |
| 6,823,317 | B1 | 11/2004 | Ouimet | |
| 6,885,311 | B2 | 4/2005 | Howard | |
| 6,889,899 | B2 | 5/2005 | Silberg | |
| 6,917,307 | B2 | 7/2005 | Li | |
| 7,002,487 | B1 | 2/2006 | Montgomery | |
| 7,014,109 | B2 | 3/2006 | Hjelmvik | |
| 7,081,832 | B2 | 7/2006 | Nelson et al. | |
| 7,104,447 | B1 | 9/2006 | Lopez | |
| 7,106,214 | B2 | 9/2006 | Jesadanont | |
| 7,114,651 | B2 | 10/2006 | Hjelmvik | |
| 7,135,991 | B2 | 11/2006 | Slemmer | |
| 7,319,974 | B1 | 1/2008 | Brusseaux | |
| 7,382,280 | B2 | 6/2008 | Long | |
| 2003/0076417 | A1 * | 4/2003 | Thomas et al. | 348/169 |
| 2006/0015395 | A1 * | 1/2006 | Wolfson et al. | 705/13 |
| 2006/0170566 | A1 | 8/2006 | Slemmer | |
| 2011/0099126 | A1 * | 4/2011 | Belani et al. | 705/418 |

* cited by examiner

*Primary Examiner* — Kevin Flynn

(57) ABSTRACT

Disclosed are an automated system for the parking of vehicles and methods for the management of a parking facility. The system comprises a communication center module for interacting with a consumer, a payment module for processing payments, a data storage module, an analysis module for detecting potential parking violations and producing one or more enforcement alerts that are communicated to enforcement officers by a parking authority. The communication center module may recognize previous users of the system using at least one of: consumer identity data, consumer biometric data, and consumer behavioral data. Parking unit identity data and consumer identity data may be conveyed by consumer contact with the parking facility. The management method comprises the steps of: communicating with a consumer, receiving parking facility controlling parameters from a parking authority, storing data, processing payments, analyzing a current operational state, detecting a potential parking violation, generating an enforcement alert, communicating the alert to a parking authority, and generating a dispatch order for parking enforcement.

18 Claims, 11 Drawing Sheets

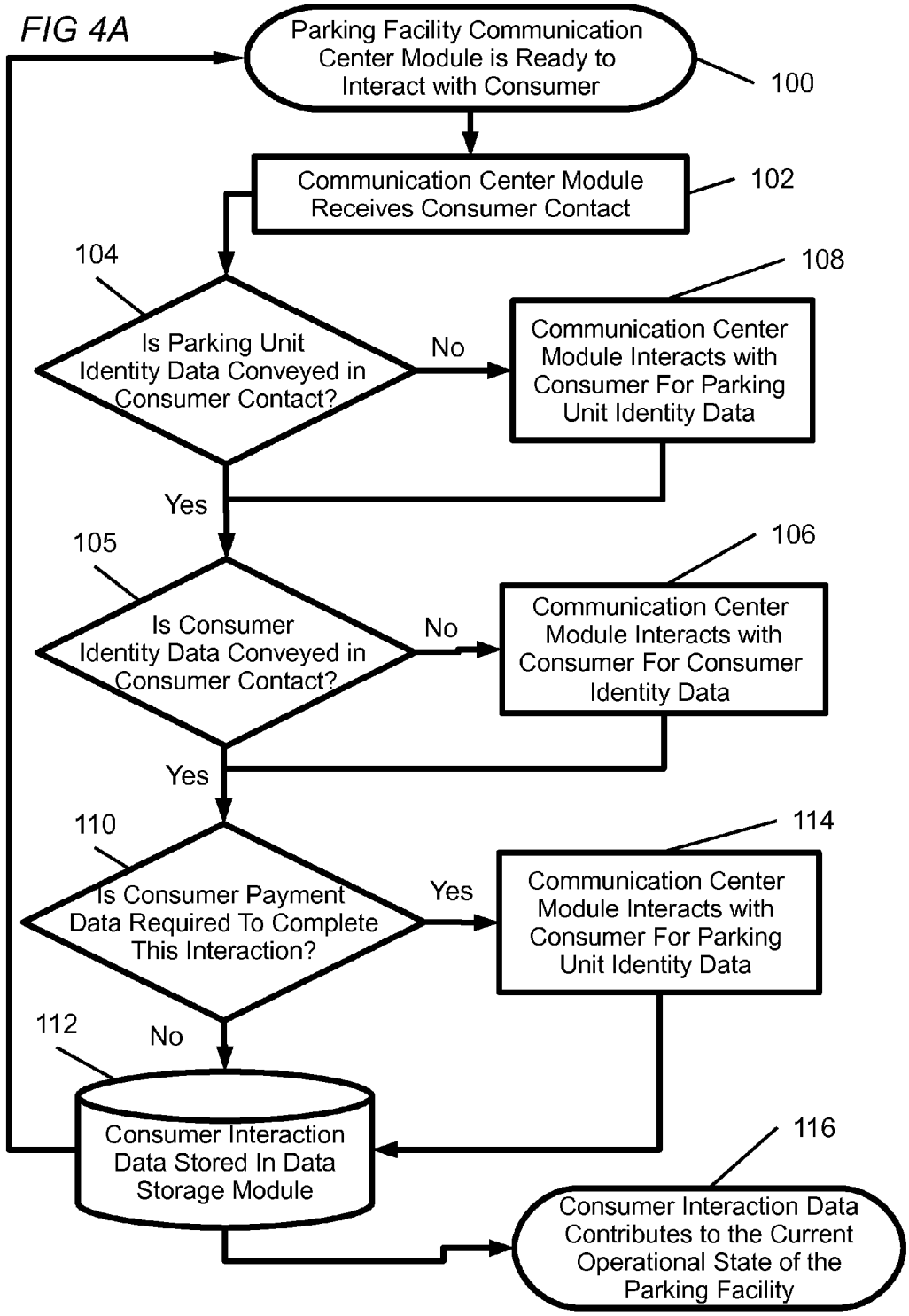
FIG 4A
Parking Facility Communication Center Module is Ready to Interact with Consumer
100
Communication Center Module Receives Consumer Contact
102
104
Is Parking Unit Identity Data Conveyed in Consumer Contact?
No
108
Communication Center Module Interacts with Consumer For Parking Unit Identity Data
Yes
105
Is Consumer Identity Data Conveyed in Consumer Contact?
No
106
Communication Center Module Interacts with Consumer For Consumer Identity Data
Yes
110
Is Consumer Payment Data Required To Complete This Interaction?
Yes
114
Communication Center Module Interacts with Consumer For Parking Unit Identity Data
112
No
Consumer Interaction Data Stored In Data Storage Module
116
Consumer Interaction Data Contributes to the Current Operational State of the Parking Facility

PARKING MANAGEMENT METHOD AND AUTOMATED PARKING SYSTEM FOR VEHICLES

CROSS REFERENCE TO RELATED APPLICATIONS

This non-provisional application claims the benefit of prior filed provisional Application No. 61/076,074 filed Jun. 26, 2008. Application No. 61/076,074 is incorporated herein by reference.

STATEMENT REGARDING FEDERALLY SPONSORED RESEARCH OR DEVELOPMENT

Not Applicable.

DESCRIPTION OF ATTACHED APPENDIX

Not Applicable.

BACKGROUND

This invention relates to parking systems and particularly to systems for automatic parking facility payment collection, monitoring, and the performance of occupancy-related management functions. This invention also relates to parking systems that integrate automatic text, voice, and picture recognition and response.

The fees charged for allowing vehicles to be parked in a managed parking facility are an important and widespread revenue stream in today's world. The basic components of a parking transaction are: a consumer with a vehicle, a parking facility, and parking facility manager. The parking facility manager generates revenue by allowing a consumer to park their vehicle in the parking facility for an amount of time. The amount of time that a vehicle is parked is variable and will be referred to as a parking period. The parking facility manager incurs expenses in managing the parking facility. Those expenses derive from, but are not limited to, the following parking management events and activities: commencement of the parking period for each vehicle, termination of the parking period for each vehicle, monitoring use of the parking facility, processing payments from consumers, and enforcement actions related to violations of policies governing the use of the parking facility. To improve the profitability of a parking facility, it is highly desirable to reduce the expenses incurred in the management of the parking facility. Therefor, it is an objective of the present invention to provide methods and a system to improve the management of a parking facility and thereby drive reductions in operating expenses.

PRIOR ART

Prior art in the field of the invention may be grouped into four groups: Group A) methods of monitoring actual parking facility use, Group B) enforcement methods, Group C) methods of interacting with consumers, and Group D) methods to register billed parking period.

Prior Art of Group A a) U.S. Pat. No. 5,432,508 discloses a technique for monitoring vehicle parking using sensors.

b) U.S. Pat. No. 6,917,307, U.S. Pat. No. 7,135,991, EU Pat. Appl. No. EP1840858A2, U.S. Pat. No. 6,344,806, U.S. Pat. No. 6,559,776, U.S. Pat. No. 6,885,311, and U.S. Pat. No. 7,104,447 disclose methods and/or systems for parking management involving parking unit sensors to detect parking lot use.

c) US Pat. Application. No. 2006/0170566A1 discloses a system which detects the presence and/or absence of a vehicle in a parking unit by means of a sensor.

d) U.S. Pat. No. 7,106,214 discloses a method to manage parking involving wireless communication and a barring mechanism. The mechanism works as both an actor and a sensor.

e) U.S. Pat. No. 7,002,487 discloses a violation surveillance system recording images of vehicles entering parking space wherein the system is essentially a video detector.

f) U.S. Pat. No. 7,382,280 discloses a violation recording system involving video surveillance cameras and a position locator mounted on a mass transit vehicle.

g) U.S. Pat. No. 7,081,832 discloses a method and apparatus for obtaining by direct measurment the occupation data for a parking location or a parking unit using proprietary devices and software.

Prior Art of Group B h) US Pat. Application No. 2006/0015395A1 discloses a parking system in which an enforcement officer has to patrol the parking facility, identify consumer by observing a dashboard card with member identification, and inquire of the system if a permission to park has been purchased and is valid.

i) U.S. Pat. No. 7,114,651 discloses a method in which an enforcement officer has to patrol the parking facility, identify consumer by vehicle registration number, and inquire of the system if a permission to park has been purchased and is valid.

j) U.S. Pat. No. 6,513,771, and U.S. Pat. No. 6,519,329 disclose parking systems in which an enforcement officer has to patrol the parking facility, identify consumer by a bar code or vehicle registration number, and inquire of the system if a permission to park has been purchased and is valid.

k) U.S. Pat. No. 6,577,248 discloses a system in which every consumer is tied to a vehicle. The parking system registers consumer parking requests and associates them with parked vehicles. An officer inquires of the system for a list of vehicles with actual parking permission. Checking on the list entries and parked vehicles is then a process performed during a patrol.

l) U.S. Pat. No. 5,905,247 discloses a parking system in which an enforcement officer has to patrol the parking facility with a control device. A vehicle-specific identification device is machine-read and automatically checked up for parking permission.

m) U.S. Pat. No. 5,740,050 discloses a parking enforcement system in which an enforcement officer has to patrol a parking facility, which is equipped with parking meters, using a mobile device, which is capable of automatic citation issuance. In the system communication occurs between three entities: a main station, a mobile device, and a parking meter. A similar system is disclosed in U.S. Pat. No. 6,812,857.

n) U.S. Pat. No. 6,243,029 discloses a method in which enforcement officer has to patrol parking facility and identify consumers by a license plate number or a registration sticker, register violators by imaging unique vehicle indicia.

Prior Art of Group C o) U.S. Pat. No. 6,026,367 discloses a method of billing for parking in which a consumer communicates with a central station by means of proprietary pay meters.

p) U.S. Pat. No. 6,823,317 discloses a parking system using wireless communication provided by a proprietary payment terminal to report and manage parking.

q) U.S. Pat. No. 6,796,499 discloses a parking toll system using wireless telephone communication to charge consumer for parking, also using proprietary entrance/exit monitors issuing/accepting parking cards to identify vehicle and parking period.

r) U.S. Pat. No. 5,940,481 discloses a parking system using wired and wireless communication to report and manage parking.

s) EU Pat. Application No. EP1770647A1 discloses a parking management method in which consumer communicates wirelessly. A parking unit is identified by uttering identifier of numerical nature.

t) US Pat. Application No. 2006/0015395A1 discloses a parking system in which consumer communicates via phone or internet. A consumer identifies herself by uttering to interactive voice recognition (IVR) a member information or by a Caller ID. A parking unit is identified by uttering identifier of numerical nature. The transaction is confirmed by personal identification number (PIN).

u) U.S. Pat. No. 6,513,771, U.S. Pat. No. 6,577,248, and U.S. Pat. No. 7,114,651 disclose systems in which a consumer sends a personal identification code via a telephone system.

v) U.S. Pat. No. 6,519,329 discloses a system in which a consumer is identified by a sensed telephone number, a cash card, key card or a code send via a telephone system.

w) U.S. Pat. No. 7,014,109 discloses a method in which a consumer is identified by a sensed telephone number, a personal identification number and a one-time code via a telephone system.

x) U.S. Pat. No. 5,297,194, U.S. Pat. No. 5,499,288, U.S. Pat. No. 5,897,616, U.S. Pat. No. 6,161,090, U.S. Pat. No. 6,526,126, and U.S. Pat. No. 6,233,556 disclose methods and/or systems to identify and verify customers using interactive voice recognition and ambiguity-resolution criteria including biometric criteria.

y) U.S. Pat. No. 6,243,029 discloses a method to monitor and charge for parking in which a consumer provides indicia for a parking unit and unique indicia for a vehicle to be positioned there. The communication of indicia to the central station can comprise of a device with build-in character recognition, or an in-car GPS enabled cellular parking validation device, or a full vehicle's indicia image.

z) U.S. Pat. No. 6,493,676 discloses a system and method where proprietary mobile parking units are installed in-vehicles to track vehicle location, communicate with central station, and charge for parking aa) U.S. Pat. No. RE37822 discloses a system in which vehicles include communication and identification means for parking automation.

Prior Art of Group D ab) US Pat. Application No. 2006/0015395A1, U.S. Pat. No. 6,889,899, and U.S. Pat. No. 7,319,974 disclose parking systems in which a consumer is required to know the duration of parking in advance.

ac) U.S. Pat. No. 6,513,771, U.S. Pat. No. 6,519,329, U.S. Pat. No. 6,577,248, U.S. Pat. No. 7,114,651, EU Pat. Application No. EP1770647A1, U.S. Pat. No. 6,243,029, and U.S. Pat. No. 7,014,109 disclose parking systems and/or methods in which consumer reports commencement and termination of a parking period.

ad) U.S. Pat. No. 6,796,499 discloses a parking toll system in which consumer reports commencement of a parking period using a telephone or internet and indicates termination of the parking period by a parking card.

The prior art uses expensive systems and complex methods to monitor parking facility use and perform enforcement service. The prior art utilizes cluttered, inconvenient, and restrictive communication methods. Accordingly, the prior art systems and methods create an inefficient parking management system. Therefore, it is an object of the present invention to provide an automated parking system and a parking management method which may obviate and mitigate the above-mentioned drawbacks.

SUMMARY

The present invention is directed to system and methods for automated management of a parking facility wherein the parking facility has a plurality of parking units that are suitable for the parking of vehicles. The system and methods disclosed herein provide certain desirable advantages: the elimination of extensive processes performed by humans, the elimination of expensive proprietary parking equipment, the elimination of mistakes made by humans, the ability to deploy simple technology, automated detection of potential parking violations, and automated dispatch of enforcement officers in response to enforcement alerts. Embodiments of the system and methods recognize previous consumers using a variety of data sources thus enhancing consumer experience, reducing operational cost, allowing the detection of potential fraudulent identity use, and allowing detection of potential fraudulent payment behavior.

An automated system for managing a parking facility that has a plurality of parking units suitable for the parking of a vehicle according to an embodiment of the present disclosure comprises: means for uniquely identifying each parking unit in said parking facility; a first communication means and a communication center module operably connected to said first communication means wherein said communication center module is a computer system adapted to interact with a consumer of said parking facility through said first communication means, wherein the interaction with said consumer conveys data comprising: consumer identity data, parking unit identity data, and, consumer payment data; a second communication means operably connected to a parking authority that interacts with said communication center module through said second communication means to provide data comprising: predetermined parking facility controlling parameters; said parking facility controlling parameters comprising: preferred communication methods, identification information for each parking unit under management in said parking facility, predetermined parking facility use data, and parking violation threshold data; a third communication means; a fourth communication means; a fifth communication means; a data storage module wherein said data storage module is a computer system adapted to interact with said communication center module through said third communication means, said data storage module also interacting with a payment processing module through said fourth communication means, and said data storage module also interacting with an analysis module through said fifth communication means; wherein the data storage module interactions comprise receiving, storing, retrieving, and sending data, said data comprising: parking violation threshold data, predetermined parking facility use data, current parking facility use data, historical parking facility use data, current consumer identity data, historical consumer identity data, current consumer payment data, and, historical consumer payment data; current enforcement report data; historical enforcement report data; wherein said payment processing module is a computer system adapted to process a payment using data received from said data storage module and generate a payment transaction with said consumer as payor; and wherein said analysis module is a computer system adapted to analyze data in said data storage module, wherein at least one item of said data represents a current operational state, wherein the analysis uses said current operational state, the predetermined parking facility use data, and, said parking violation threshold data to produce a first enforcement alert in response to detecting a potential violation of said parking facility; a sixth communication means operably connected to said analysis module and to said parking authority, wherein said first enforcement alert is communicated to said parking authority; a seventh communication means operably connected between said parking authority and at least one enforcement officer; wherein said parking authority is adapted to carry out the management actions comprising: receiving said first enforcement alert, generating a dispatch order for at least one enforcement officer in response to said first enforcement alert, and communicating said dispatch order to said enforcement officer through communication means seven; producing a first enforcement report summarizing the actions taken and results obtained by said enforcement officer in the course of the enforcement officer's response to said first enforcement alert, and, communicating said first enforcement report to said communication center module through communication means two.

In a related embodiment of the system, parking unit identity data is located in close proximity to the parking unit to which it pertains, said parking unit identity data is in human readable form, and said parking unit identity data is positioned to be readable while the vehicle occupies the parking unit to which said parking unit identity data pertains. The system may additionally comprise: contact information indicating how said consumer is to initiate communication with said communication center module; wherein said contact information is located in close proximity to said parking unit identity data, and wherein the consumer interaction with said communication center module conveys data further comprising some of the contact information used by said consumer.

In a related embodiment of the system, the communication center module interaction with said consumer comprises a check-in interaction at the commencement of a parking period, wherein the parking period is an amount of time, and, wherein the time and date of said check-in interaction is stored in said data storage module.

In a related embodiment of the system, the communication center module interaction with said consumer comprises a check-out interaction at the termination of said parking period, wherein the parking period is an amount of time, and, wherein the time and date of said check-out interaction is stored in said data storage module.

In a related embodiment of the system, said consumer identity data comprises at least one item selected from a group consisting of consumer biometric data and consumer behavioral data. The communication center module may also be adapted to identify a mismatch between a first item of consumer identity data and a second item of consumer identity data, produce a second enforcement alert, and communicate said second enforcement alert to said parking authority through said second communication means, and wherein said parking authority is adapted to carry out additional management actions comprising: receiving said second enforcement alert and dispatching at least one enforcement officer in response to said second enforcement alert, producing a second enforcement report summarizing the actions taken and results obtained by said enforcement officer in the course of the enforcement officer's response to said second enforcement alert, and, communicating said second enforcement report to said communication center module through said second communication means.

In a related embodiment of the system, the communication center module is adapted to recognize previous consumers of the parking facility, identify consumers of the parking facility who provide faulty consumer payment data, produce a third enforcement alert, and, communicate said third enforcement alert to said parking authority, and wherein the parking authority is adapted to carry out additional management actions comprising: receiving said third enforcement alert and dispatching at least one enforcement officer in response to said third enforcement alert, producing a third enforcement report summarizing the actions taken and results obtained by said enforcement officer in the course of the enforcement officer's response to said third enforcement alert, and, communicating said third enforcement report to said communication center module through said second communication means.

In a related embodiment of the system, the system additionally comprises: an eighth communication means, and at least one parking unit that comprises parking unit occupancy sensing equipment, wherein said occupancy sensing equipment communicates the occupancy state of said parking unit through said eighth communication means to said communication center module.

In a related embodiment of the system, the parking authority is adapted to carry out management actions further comprising: dispatching said enforcement officer to audit the actual occupancy state of at least one or more said parking units through said seventh communication means, producing an occupancy report summarizing the occupancy state of one or more parking units, and communicating said occupancy report to said communication center module through said second communication means.

A method of managing a parking facility according to an embodiment of the present disclosure comprises the steps of: communicating with a consumer of said parking facility; storing data received from said consumer in a data storage module; processing payments from said consumer of said parking facility; receiving parking facility controlling parameters from a parking authority, wherein said parking facility controlling parameters comprise: preferred communication methods, identification information for each parking unit under management in said parking facility, predetermined parking facility use data, and parking violation threshold data; analyzing a set of data wherein said set of data comprises: a current operational state, said predetermined parking facility use data, and, said parking violation threshold data, wherein at least one item of the data stored in said data storage module represents the current operational state; detecting a potential parking violation; generating a first enforcement alert based on the detection of the potential parking violation; communicating said first enforcement alert to said parking authority; and, generating a dispatch order for parking enforcement.

In a related embodiment of the method, the step of communicating with a consumer conveys data comprising: consumer identity data and parking unit identity data.

In a related embodiment of the method, the communication with said consumer conveys data additionally comprising consumer payment data.

In a related embodiment of the method, the communication with said consumer conveys consumer identity data comprising at least one item from a group consisting of consumer biometric data and consumer behavioral data, the method additionally comprising the steps of: comparing said consumer identity data with data stored in said data storage module; detecting a difference between said consumer identity data and data stored in said data storage module; generating a second enforcement alert based on said difference; communicating said second enforcement alert to said parking authority; and generating a dispatch order for parking enforcement.

In a related embodiment of the method, the method further comprises the steps of: receiving enforcement report data from said parking authority, and, storing enforcement report data in said data storage module.

In a related embodiment of the method, the step of communicating with a consumer of said parking facility comprises: a first communication with said consumer, and, a second communication with said consumer.

In a related embodiment of the method, the method additionally comprises the steps of: recognizing previous consumers of said parking facility; detecting consumers who provide faulty consumer payment data; generating a third enforcement alert based on detection of said faulty consumer payment data; communicating said third enforcement alert to said parking authority; and, generating a dispatch order for parking enforcement.

In a related embodiment of the method, the method further comprises the step of: adjusting the predetermined parking facility use data using data acquired through operation of said parking facility, wherein the data used for adjusting comprises at least one item of data from the group consisting of: parking violation threshold data, current parking facility use data, historical parking facility use data, current consumer identity data, historical consumer identity data, current consumer payment data, historical consumer payment data, current enforcement report data, and, historical enforcement report data.

In a related embodiment of the method, the method further comprises the step of: adjusting the parking violation threshold data using data acquired through operation of said parking facility, wherein the data used for adjusting comprises at least one item of data from the group consisting of: predetermined parking facility use data, current parking facility use data, historical parking facility use data, current consumer identity data, historical consumer identity data, current consumer payment data, historical consumer payment data, current enforcement report data, and, historical enforcement report data.

BRIEF DESCRIPTION OF THE DRAWINGS

These and other features, aspects, and advantages of the present invention will become better understood with regard to the following description, appended claims, and accompanying drawings where:

FIG. 4A shows a flow chart indicating the interaction between a consumer and an automated system for the parking of vehicles according to an embodiment of the present disclosure.

LIST OF REFERENCE NUMBERS APPEARING IN THE FIGURES

Figure 1:
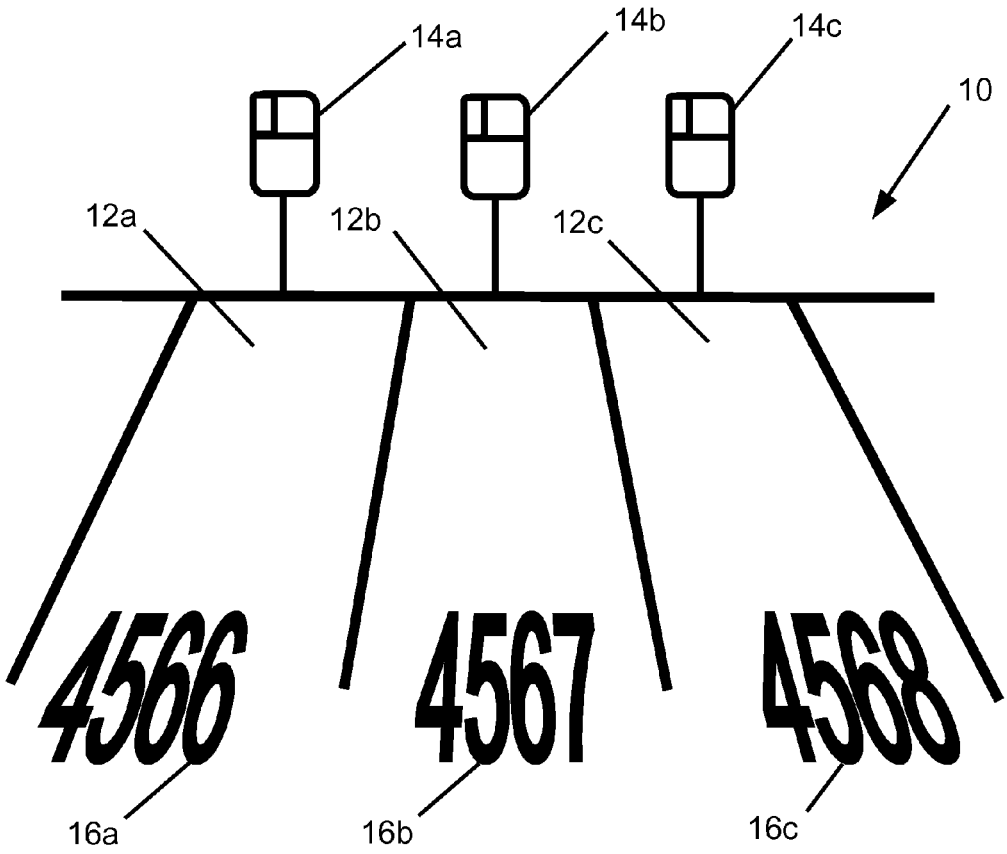
FIG. 1 shows a perspective view of a portion of a parking facility according to a preferred embodiment of the present disclosure.

10, 10*a*—parking facility
12, 12*a*, 12*b*, 12*c*—parking unit
14, 14*a*, 14*b*, 14*c*—contact information signage
16, 16*a*, 16*b*, 16*c*—parking unit identity data
17, 17*a*, 17*b*—contact information for the parking facility
18, 18*a*, 18*b*—automated system for the management of a parking facility
20—consumer of the parking facility
22—communication center module
24—data storage module
26—payment processing module
28—analysis module
30—parking authority
32, 32*a*, 32*b*—enforcement officer
34, 34*a*, 34*b*, 34*c*—enforcement alert
36, 36*a*, 36*b*, 36*c*—enforcement report
41—first communication means
42—second communication means
43—third communication means
44—fourth communication means
45—fifth communication means
46—sixth communication means
47—seventh communication means
48—eighth communication means
50—consumer interaction data
52—consumer identity data
53—consumer biometric data
54—consumer behavioral data
56—consumer payment data
60—predetermined parking facility controlling parameters
62—preferred communication methods

64—identification information for each parking unit under management in said parking facility
66—parking facility use data
68—parking violation threshold data
70—parking unit occupancy sensor
72—occupancy report

DESCRIPTION

The present invention is now described with reference to the drawings, wherein like reference numerals are used to refer to like elements throughout. In the following description, for purposes of explanation, numerous specific details are set forth in order to provide a thorough understanding of the present invention. It may be evident, however, that the present invention can be practiced without these specific details. In other instances, well-known structures and devices are shown in block diagram form in order to facilitate describing the present invention.

As used in this application, the terms "module" and "system" are intended to refer to a computer-related entity, either hardware, a combination of hardware and software, software, or software in execution. For example, a module can be, but is not limited to being, a process running on a processor, a processor, an object, an executable, a thread of execution, a program, and/or a computer. By way of illustration, both an application running on a server and the server can be a module. One or more modules can reside within a process and/or thread of execution, and a module can be localized on one computer and/or distributed between two or more computers.

In addition, as used in this application, the term "communication means" is intended to refer to any suitable communications infrastructure capable of and operably connected to perform communication of data from one system, module, or person to another system, module, or person. A variety of data types may be communicated by the communication means wherein the data types may comprise: analog representations of voice data, digital representations of voice data, alphanumeric data, textual data, two dimensional image data, biometric data, behavioral data, and binary data. A particular communication means need only communicate one of the aforementioned data types, and it may communicate any combination of data types as suits the particular application of the particular communication means. Specific communication means considered suitable for embodiments of the present disclosure comprise: cell phone voice, cell phone data, cell phone combined voice and data, wired phone voice, wired phone data, wired phone combined voice and data, short message service (SMS), multimedia messaging service (MMS), private branch exchange (PBX), email, wired internet, wireless internet, wired intranet, wireless intranet, radio link, in-person voice, and in-person writing.

Turning now to FIG. 1, there is shown a perspective view of a portion of an exemplary parking facility 10. Parking facility 10 comprises at least one parking unit 12 that is suitable for the parking of a vehicle. The parking facility of FIG. 1 shows: parking units 12*a*, 12*b*, and 12*c* which are suitable for the parking of vehicles; parking unit identity data 16*a*, 16*b*, and 16*c*, wherein the parking unit identity data uniquely identifies each individual parking unit, and wherein parking unit identity data is located in close proximity to the parking unit to which it pertains; contact information signage 14*a*, 14*b*, and 14*c*, displays contact information 17 used by the consumer in contacting the parking facility, wherein contact information 17 may be used to commence a parking period, and, may be used again to terminate a parking period, and wherein a parking period is an amount of time that the consumer parks their vehicle at the parking facility. Parking unit identity data 16*a*, 16*b*, and 16*c*, are made available in close proximity to the parking units to which the parking unit identity data 16 pertains in such a way as to be visible when a vehicle is parked in the parking unit 12.

Figure 2A:
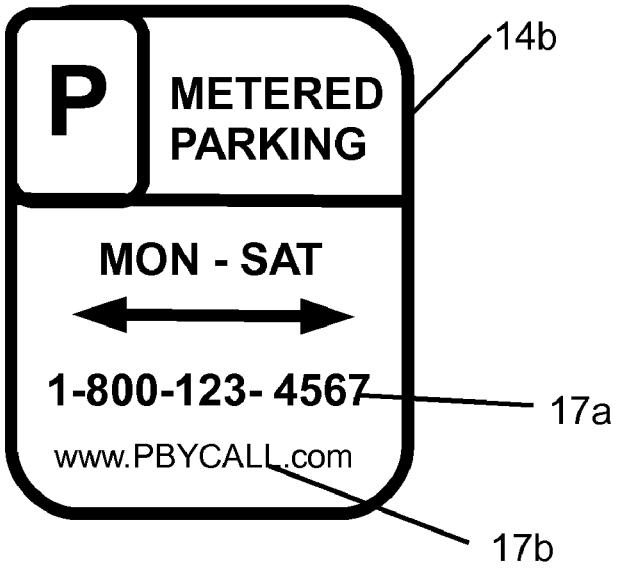
FIGS. 2A and 2B show two embodiments of parking facility contact information displayed on signage.
Figure 2B:
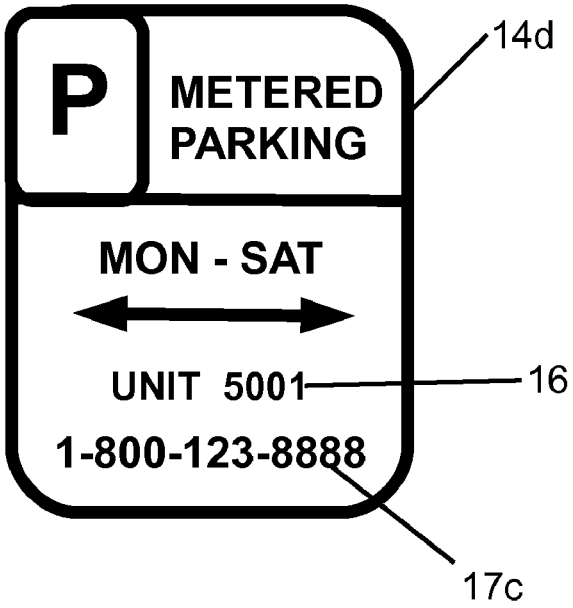

Turning now to FIG. 2A and FIG. 2B, there are shown two different embodiments of contact information signage, 14*b* and 14*d*, respectively. Both figures show contact information 17 printed on signage in human readable form. FIG. 2A shows contact information signage 14*b* displaying two different items of contact information, 1) 17*a* which is a phone number that may be used by consumer 20 for contacting the parking facility 10, and 2) 17*b* which is a web address that may be used by a consumer 20 for contacting the parking facility 10. In 17*a*, the contact phone number, in addition to being a phone number, also conveys information about the parking unit that the consumer has chosen, wherein the parking unit identity data is conveyed by the four digits at the end of the contact phone number. Numerous variations on the concept of embedding parking unit identity data 16 in contact information 17 are within the scope and spirit of this disclosure. Another embodiment of contact information that additionally combines parking unit identity data is a web address that appends parking unit identity data, for example, a number, to a base web address, for example, "www.PBYCALL.com" thus yielding contact information for the parking unit identified by the number 4567 of "www.PBYCALL.com/4567" which is readily understood to be a web address unique to parking unit 4567. While the use of four digits for the parking unit identity data is preferred in the foregoing examples it should not be construed as a limitation to only four digits, as it may be useful to use a different number of digits as necessary to distinguish each unique parking unit from all others in the parking facility.

FIG. 2B shows contact information printed on signage that not only displays contact information 17*c* but also simultaneously displays parking unit identity data 16. A parking facility using the embodiment shown in FIG. 2B may associate one unique item of signage to each parking unit in the parking facility.

While FIG. 2A and FIG. 2B present certain preferred embodiments of contact information and parking unit identity data other embodiments are possible and may readily be considered by those skilled in the art to be within the scope and spirit of this disclosure.

Figure 3:
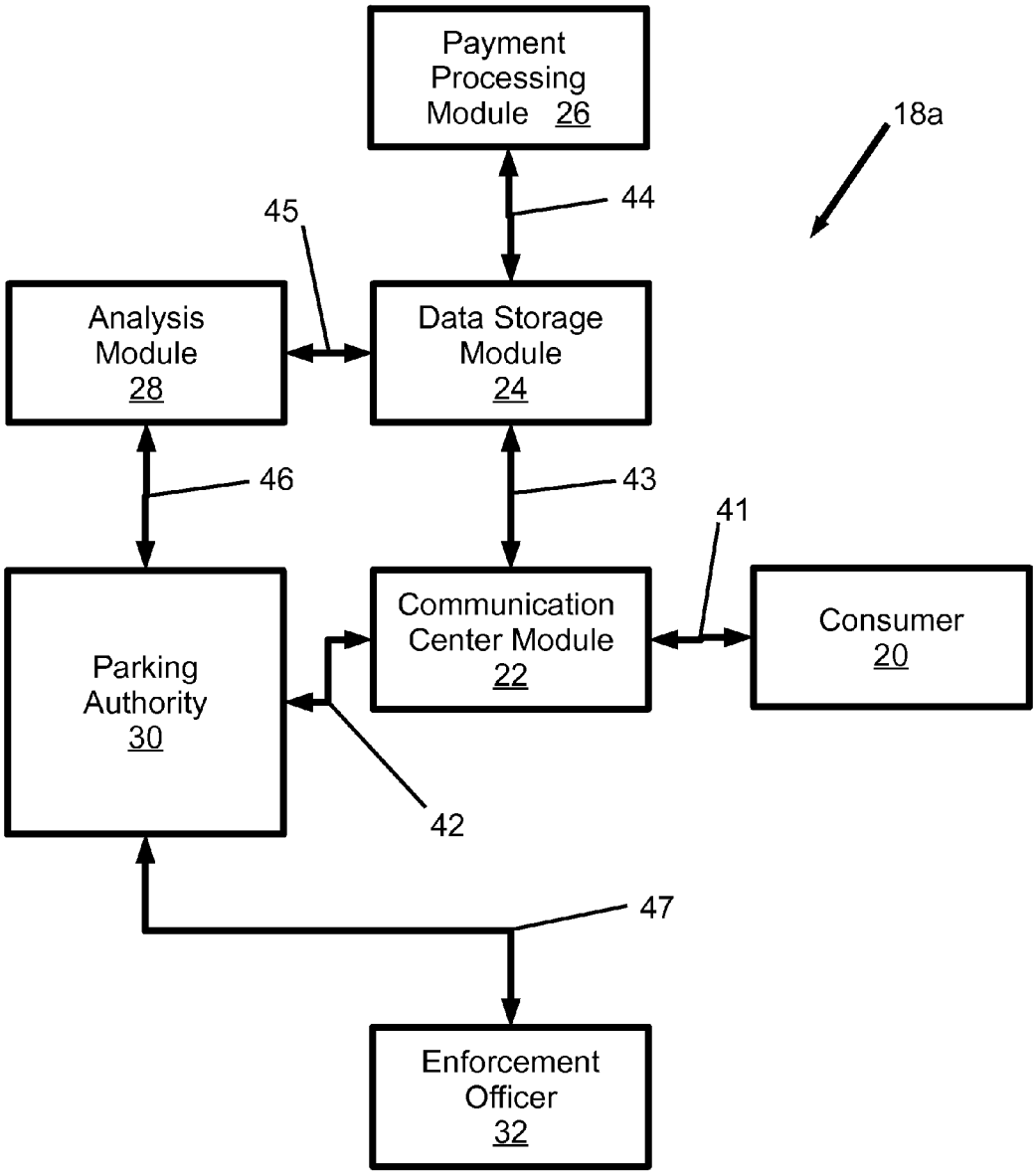
FIG. 3 shows a block diagram of an automated system for the parking of vehicles according to an embodiment of the present disclosure.

Turning now to FIG. 3, there is shown a block diagram of an automated system for the parking of vehicles 18*a* according to an embodiment of the present disclosure. Communication center module 22 is operably connected through a first communication means 41 to interact with a consumer 20. Communication center module 22 is a computer system adapted to interact with the consumer, wherein the interaction exchanges data comprising: data needed for the commencement and termination of a parking period at the parking facility, data needed to identify the consumer, data needed to identify the parking unit that the consumer has selected for parking their vehicle, and data needed to process a payment transaction with the consumer as payor and one or more agents of the parking facility as payee. Furthermore, communication center module 22 is adapted to interactively elicit from consumer 20 the data required to both commence a parking period and to terminate a parking period.

Continuing with FIG. 3, there is also shown a data storage module 24 that is operably connected through a third communication means to interact with communication center module 22. Data storage module 24 is a computer system adapted to receive, store, retrieve, and send data, through any operably connected communication means. Data stored in data storage module 24 may pertain to the initial setup of automated system for the parking of vehicles 18*a*. Data stored in data storage module 24 may pertain to the ongoing operations of automated system for the parking of vehicles 18*a*. Data storage module 24 is operably connected through a fourth communication means 44 to a payment processing module 26. Data storage module 24 is operably connected through a fifth communication means 45 to an analysis module 28. In addition, analysis module 28 is operably connected through a sixth communication means 46 to a parking authority 30.

Payment processing module 26 is a computer system adapted to process a payment transaction with the consumer as payor and one or more agents of the parking facility as payee, using data available in data storage module 24. Payment processing module may also be adapted to detect when potentially fraudulent consumer payment data has been given by consumer 20. Payment processing module 26 may then generate an enforcement alert 34 in response to said detection and may additionally cause said alert to be communicated through the system 18*a* to parking authority 30. Parking authority 30 may then dispatch an enforcement officer 32 through seventh communication means 47 to investigate and act upon potential payment fraud. Furthermore, enforcement alert 34 data may be communicated through the system 18*a* for storage in data storage module 24.

Continuing with FIG. 3, there is also shown a parking authority 30 that interacts with communication center module 22 through a second communication means 42, wherein the interaction between the two has many purposes, those purposes at least comprising: initial setup of the automated system for the parking of vehicles 18*a*, and the ongoing operation of the system. During initial setup parking authority 30 exchanges data with communication center module for the initialization of the modules relied upon to carry out the functions of the system. Communication center module 24 is operably connected to a data storage module 24 through a third communication means and thereby any data exchanged between parking authority 30 and communication center module 22 may be stored in data storage module 24. Data exchanged from parking authority 30 during initial setup are predetermined parking facility controlling parameters 60, and those data comprise: preferred communication methods 62, identification information for each parking unit under management 64, predetermined parking facility use data 66, and parking violation threshold data 68. Preferred communication methods 62 are used to configure each of the communication means used by the system. Identification information for each parking unit under management 64 comprises the location of each parking unit 12, and the parking unit identity data 16 associated with each parking unit 12. Predetermined parking facility use data 66 describe the expected operation of parking facility 10, the deviation from which is considered indicative of a parking violation. The farther the current operational state of the parking facility deviates from the predetermined parking facility use data, the greater the expectation is that a parking violation is in progress. Parking violation threshold data 68 represents the amount of deviation from the predetermined parking facility use data that is required in the current operational state before a potential parking violation is considered detected. Upon the detection of a potential parking violation, analysis module 28 sends an enforcement alert to parking authority 30 through sixth communication means 46. Parking authority 30, in response to the receipt of said enforcement alert, dispatches through operably connected seventh communication means, enforcement officer 32 to investigate and handle the potential parking violation. Parking authority 30, may, instead of dispatching enforcement officer 32 directly after each potential parking violation is detected, send a dispatch order containing the details pertaining to multiple potential parking violation so that enforcement officer 32 investigates and handles a plurality of potential parking violations after a single dispatch. At the conclusion of the enforcement officer's investigation and handling of one or more potential parking violations said parking authority may produce an enforcement report summarizing the actions taken and results obtained by said enforcement officer 32 in the course of the enforcement officer's response to said enforcement alert, and, may then communicate the enforcement report to said communication center module through second communication means 41. Parking authority 30 may also rank order the enforcement alerts it receives by the degree of potential violation detected, wherein rank ordering allows parking authority 30 to issue dispatch orders to enforcement officers 32 based on the degree of violation and current enforcement officer load.

Analysis module 28 is a computer system adapted to analyze the current operational state of parking facility 10 with respect to the predetermined parking facility controlling parameters. The current operational state of the parking facility is the collection of data comprising: current and historical consumer identity data received from consumers, current and historical parking facility use data, current and historical consumer payment data received from consumer, parking violation threshold data, current enforcement report data, and historical enforcement report data. Analysis module 28 uses algorithms for the analysis of the current operational state, estimation of deviation of the current operational state from the predetermined parking facility use data, application of parking violation threshold data to the analysis, and the detection of potential parking violation wherein at least one said algorithm is taken from the group of algorithms consisting of: statistical, probabilistic, expert systems, approximate reasoning, and artificial intelligence.

Analysis module 28 may also comprise machine learning algorithms that are able to adapt using data stored in data storage module 24. Data items that may be adapted comprise, parking facility use data, and parking violation threshold data. Algorithms used in the analysis may also be adapted, algorithmic items that may be adapted comprise: analysis of the current operational state, estimation of deviation of the current operational state from the predetermined parking facility use data, application of parking violation threshold data to the analysis, and the detection of potential parking violation.

Turning now to FIG. 4A there is shown a flow chart indicating the interaction between the consumer 20 and an automated system for the parking of vehicles 18*a* according to an embodiment of the present disclosure. At the entry point of the flow chart 100 the parking facility 10 has already been configured for operation with the predetermined parking facility controlling parameters and is ready for interaction with consumer 20. In process 102 communication center module 22 receives a contact from consumer through first communication means 41. Decision block 104 ascertains whether parking unit identity data is conveyed by consumer contact. If parking unit identity data is not conveyed by the initial consumer contact then process 108 interacts with consumer 20 to inquire for parking unit identity data.

With continuing reference to FIG. 4A, the interaction with consumer 20 continues with decision block 105. Decision block 105 ascertains whether consumer identity data is conveyed by consumer contact. If consumer identity data 52 is not conveyed by the initial consumer contact the process 106 interacts with consumer 20 to obtain consumer identity data. Consumer identity data 52 comprises, but is not limited to, the following data: name, birth date, social security number, place of residence, phone number, mailing address, family related data, employment related data. There are a number of preferred embodiments in which consumer identity 52 data may be conveyed by the consumer contact, and among these are, Caller ID when the means of contact is a phone, and electronic serial number when the means of contact is a smart phone device.

With continuing reference to FIG. 4A, the interaction with consumer 20 continues with decision block 110 which ascertains whether consumer payment data is required to complete the present interaction with consumer 20. If consumer payment data is required to complete the present interaction with the consumer then that data is acquired by process 114 of communication center module 22 through interaction with consumer 20. Examples of payment data are not limited to the following: credit card number and authorization, debit card number and authorization, electronic funds transfer data and authorization, and consumer billing information. Process 112 stores data acquired through interaction with consumer 20 in data storage module 24, wherein the data acquired through interaction with the consumer may is considered, by process 116, data representing at least part of the current operational state of the parking facility. After step 112 the consumer interaction process flows back to entry point 100 whereby the entire process shown in FIG. 4A may commence again as necessary to interact with the next consumer.

Figure 4B:
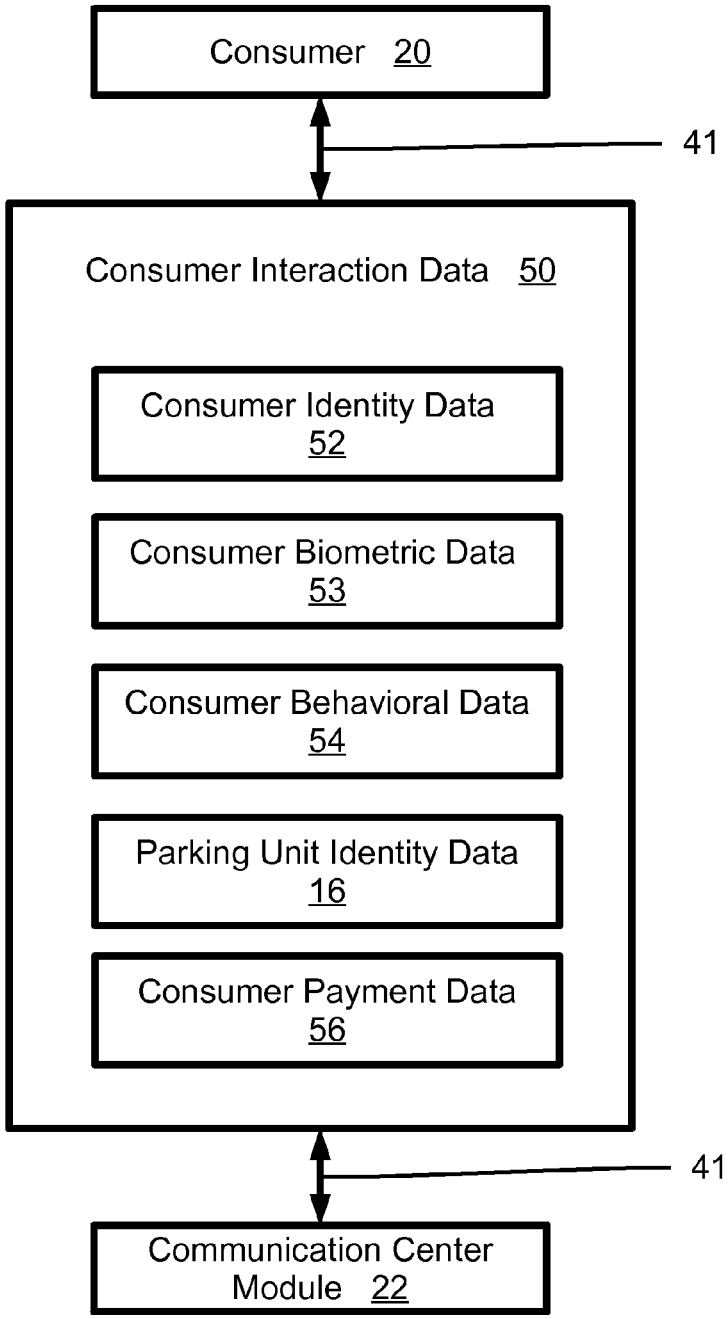
FIG. 4B shows a flow chart indicating the flow of consumer interaction data between a consumer and a communication system module in an automated system for the parking of vehicles according to an embodiment of the present disclosure.

Turning now to FIG. 4B there is shown a flow chart indicating the flow of consumer interaction data 50 between consumer 20 and communication system module 22 in an automated system for the parking of vehicles 18*a* according to an embodiment of the present disclosure. As indicated by the figure, the totality of data generated by interaction with consumer 20 may be called consumer interaction data 50. Consumer interaction data 50 is communicated through first communication means 41 to communication center module 22 for use in the operation of parking facility 10. Consumer interaction data comprises data that may be identified as belonging to a number of subgroups of data wherein those subgroups may be among the groups: consumer identity data 52, consumer biometric data 53, consumer behavioral data 54, parking unit identity data 16, and consumer payment data 56.

As indicated in FIG. 4B both consumer biometric data and consumer behavioral data may be conveyed as part of consumer interaction data 50. Consumer biometric data comprises, but is not limited to, the following data: voice print, finger print, retinal pattern, and personal likeness as conveyed by two dimensional image data. A preferred embodiment captures voice print data during a consumer interaction as it takes place over first communications means 41, wherein first communication means 41 is adapted to communicate voice data. Consumer behavioral data comprises, but is not limited to, the following data: speech utterances, language spoken, location of parking facility used by consumer, location of parking unit identified by consumer, time of commencement of parking period, time of termination of parking period. A preferred embodiment captures vocal behavioral data during a consumer interaction as it takes place over first communication means 41, wherein first communication means 41 is adapted to communicate voice data.

Communication module 22 may be adapted to compare current consumer biometric data 53 with consumer biometric data acquired through prior interactions with consumers. Communication module 22 may also be adapted to compare current consumer behavioral data 54 with consumer behavioral data acquired through prior interactions with consumers. Communication module 22 may also be adapted to compare current consumer identity 52 data with consumer identity data acquired through prior interactions with consumers. Any of the foregoing comparisons may be used to match a currently interacting consumer with records of prior consumers and in this way prior consumers may be recognized. In addition, mismatches may be detected between items of consumer interaction data that may be indicative of fraudulent activity on the part of the current consumer or previous consumers. In the case that a mismatch is detected an enforcement alert may be generated by communication center module 22 and communicated through second communication means 42 to parking authority 30, where parking authority may, in turn, generate a dispatch order for parking enforcement and may communicate that dispatch order to enforcement officer 32 through seventh communication means 47.

Figure 5:
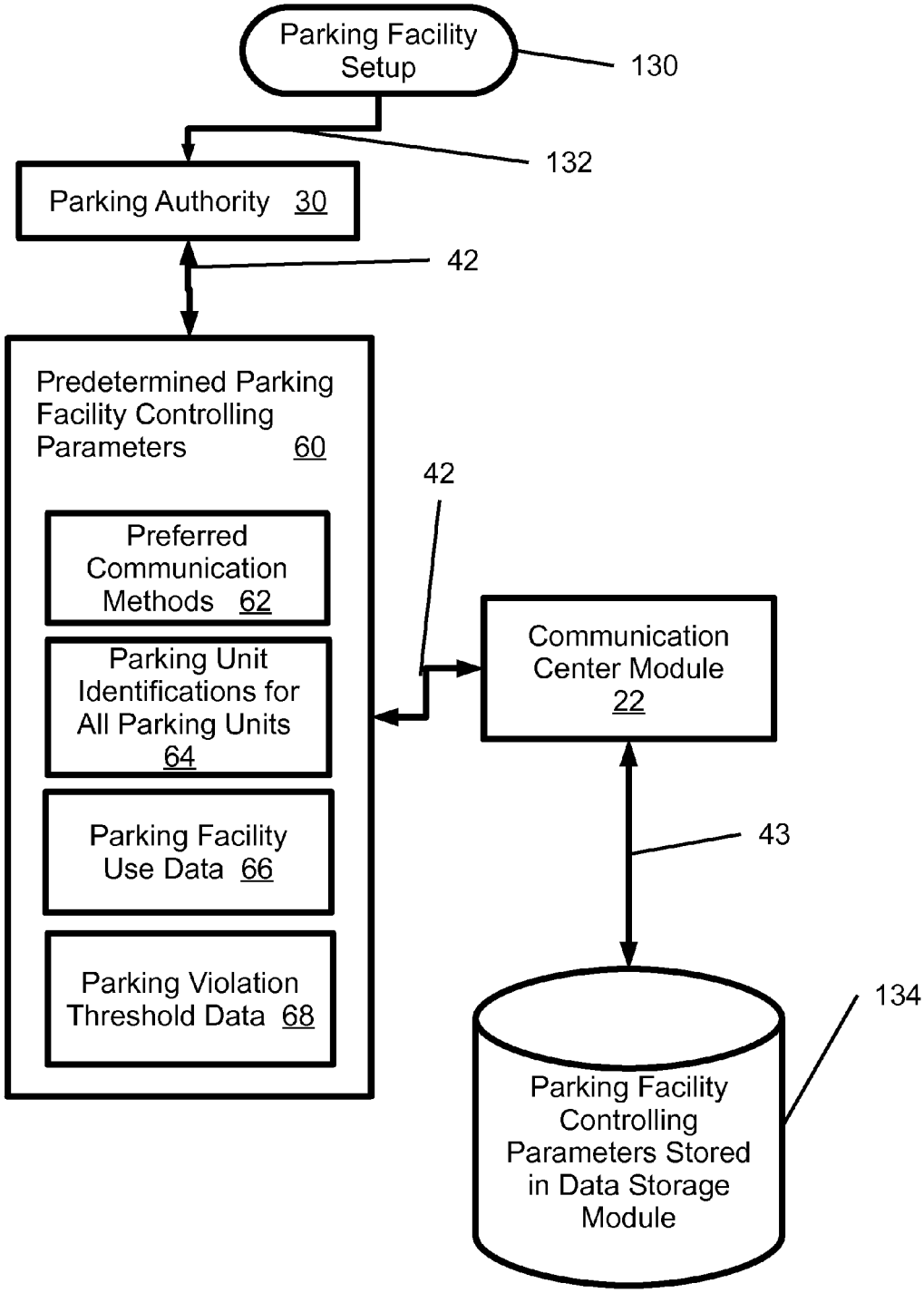
FIG. 5 shows a flow chart indicating the initial set up by a parking authority of an automated system for the parking of vehicles according to an embodiment of the present disclosure.

Turning now to FIG. 5, there is shown a flow chart indicating the initial setup by parking authority 30 of an automated system for the parking of vehicles 18*a* according to an embodiment of the present disclosure. Parking facility setup 130 is initiated by communicating action 132 to parking authority 30. Parking authority 30 communicates predetermined parking facility controlling parameters 60 through second communication means 42 to communication center module 22. In step 134 communication center module 22 stores the received predetermined parking facility controlling parameters 60 in data storage module 24 using third communication means 43. In a preferred embodiment predetermined parking facility controlling parameters 60 comprise: preferred communication methods 62, parking unit identification information for each parking unit under management 64, parking facility use data 66, and parking violation threshold data 68.

While the foregoing parking facility controlling parameters 60 have be described with respect to a preferred embodiment, other embodiments are within the spirit and scope of this disclosure. As such parking facility controlling parameters may comprise any combination of the following parameters: management methods such as vacancy targeting or occupancy targeting, cost parameters such as basis charge, progressive charges, demand-related charges, communication preferences in general such as assignments of officers to certain parts of facility, and parking facility geometry and geographic location of parking units thus extending the parking unit identification information.

Figure 6:
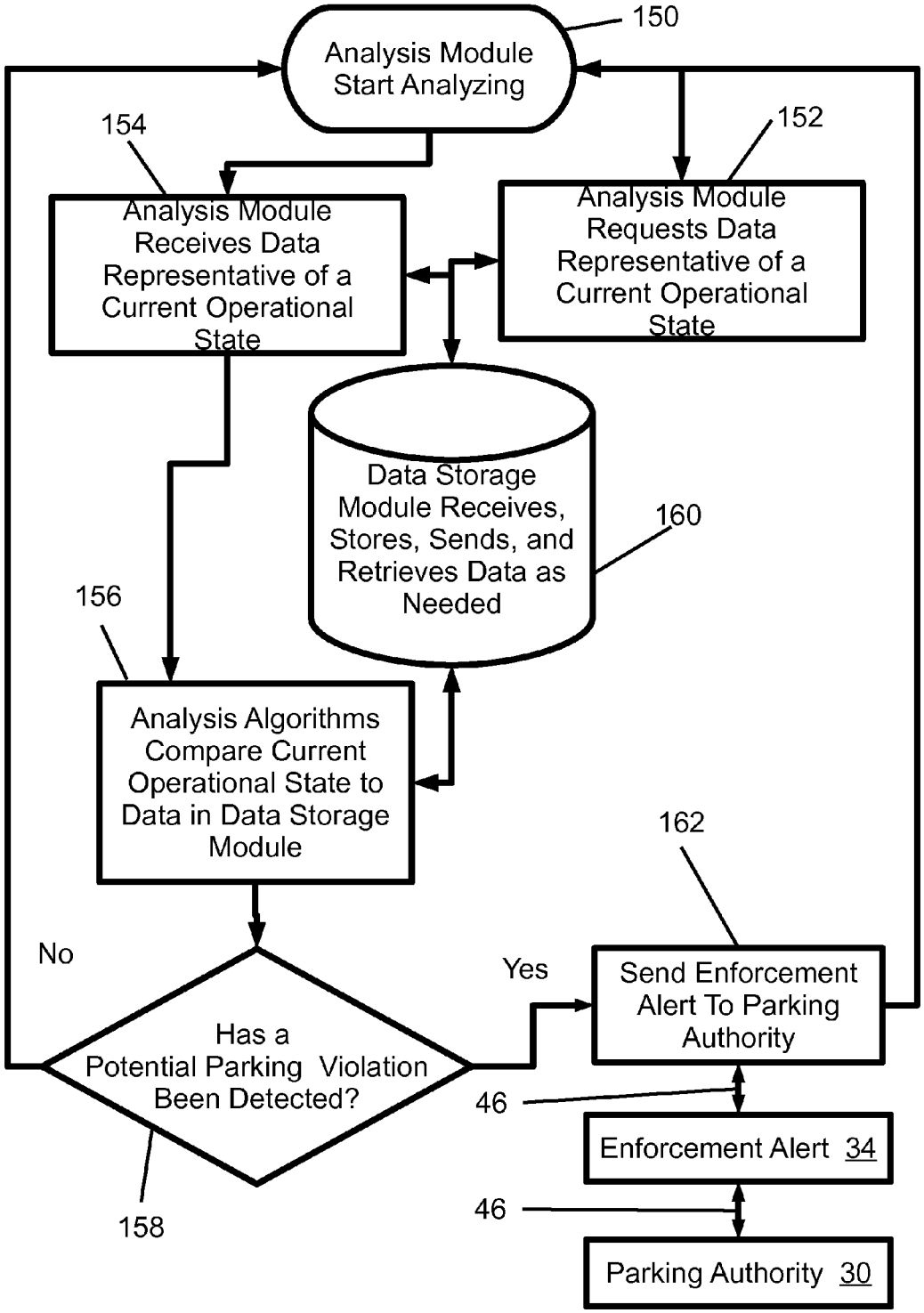
FIG. 6 shows a flow chart indicating the operation of an analysis module operating according to an embodiment of the present disclosure of an automated system for the parking of vehicles.

Turning now to FIG. 6, there is shown a flow chart indicating the operation of an analysis module operating according to an embodiment of the present disclosure of an automated system for the parking of vehicles. Analysis module 28 is a computer system adapted to perform the analysis required to detect one or more parking violations using at least one item of data stored in data storage module 24. At the entry point of the flowchart 150, analysis module 28 has already been configured to communicate with both data storage module 24 and parking authority 30 through fifth and sixth communication means, respectively. Analysis module 28 may start its analysis automatically as in step 152, or it may be caused to start by receipt of an externally generated action or data as in step 154. In both steps 152 and 154 the analysis uses at least one item of data from data storage module to represent a current operational state of the parking facility. Step 156 performs the analysis on the current operational state using additional data stored in data storage module 24. As indicated by step 160, data may be both consumed and produced during the course of the analysis consumed and that data may be received, stored, sent, and retrieved by data storage module 24. In a preferred embodiment data used for analysis comprises: parking facility use data 66, and parking violation threshold data 68, which may both be initialized to predetermined values at the time that parking facility 10 is setup. Analysis step 156 is followed by decision step 158 wherein a potential parking violation is detection or not detected. If no potential parking violation is detected then the process flows back to the entry point 150 whereby the entire process shown in FIG. 6 may commence again. If a potential parking violation is detected then the flowchart proceeds to step 162 wherein an enforcement alert 34 is generated by analysis module 28 and is sent to parking authority 30 through sixth communication means 46. After enforcement alert 34 is sent at step 162 the analysis process flows back to the entry point 150 whereby the entire process shown in FIG. 6 may commence again.

Figure 7A:
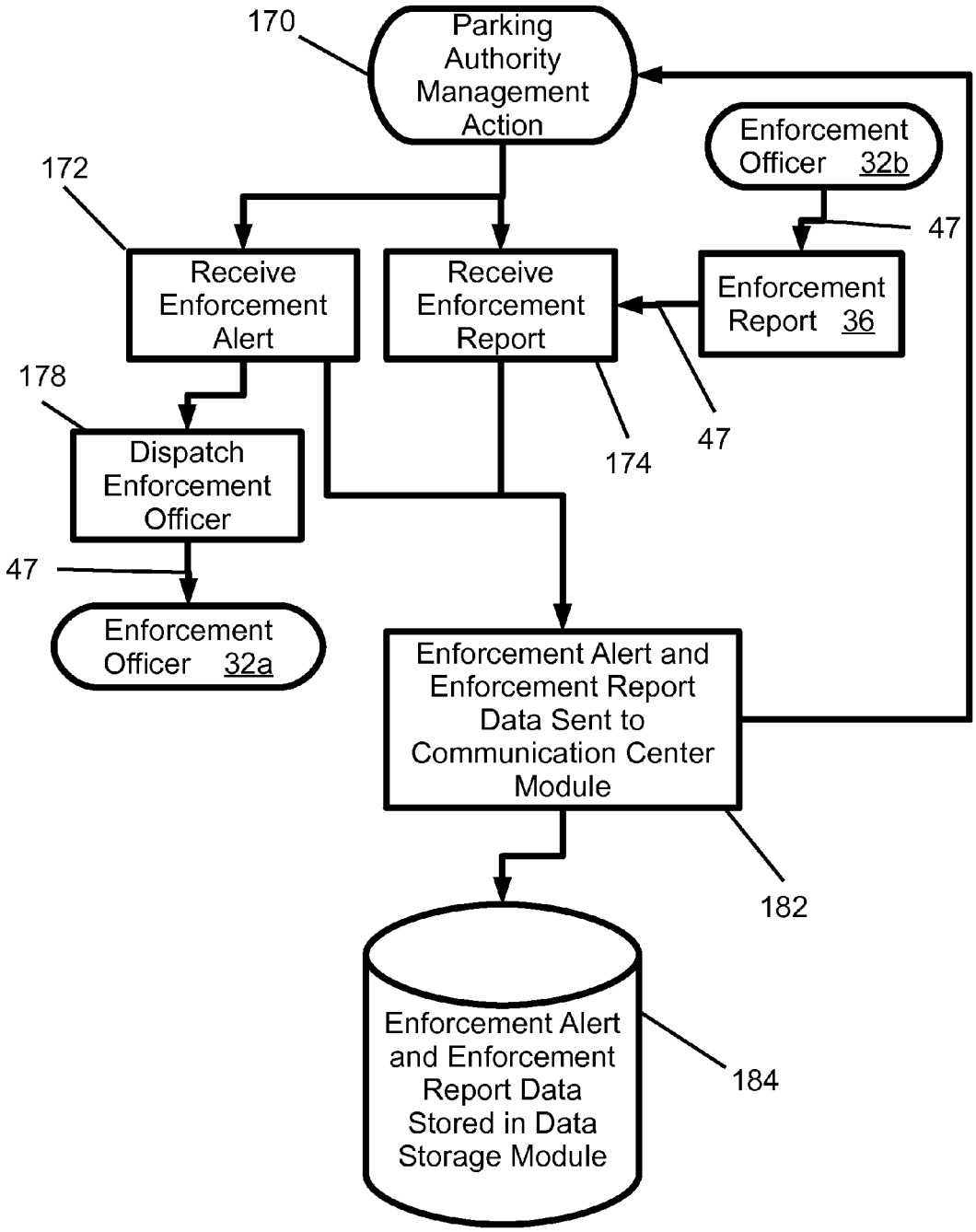
FIG. 7A shows a flow chart indicating enforcement related actions of a parking authority operating according to an embodiment of the present disclosure.

Turning now to FIG. 7A, there is shown a flow chart indicating enforcement related actions of a parking authority operating according to an embodiment of the present disclosure. As indicated in FIG. 7A, parking authority 30 carries out enforcement related actions in addition to actions performed during parking facility setup. Step 170 is the entry point for the enforcement related actions of parking authority 30. Enforcement alert 34 is received by parking authority 30 in step 172. Parking authority 30 responds to enforcement alert 34 by dispatching at step 178 enforcement officer 32*a*. Dispatch of enforcement officer is communicated to enforcement officer 32*a* through seventh communication means 47. Enforcement alert 34 is also communicated through second communication means to communication center module at step 182. At step 184 enforcement alert data is stored in data storage module 24. After step 182 the process flows back to the entry point 170 whereby the entire process shown in FIG. 7A may commence again.

Continuing with FIG. 7A, there is also shown step 174 in which parking authority 30 receives an enforcement report 36 from enforcement officer 32*b*. Enforcement report 36 contains information pertaining to actions taken by enforcement officer 32*b* and results obtained by enforcement officer 32*b* during the course of that enforcement officer's response to a prior enforcement dispatch. Enforcement report 36 is communicated to communication center module 22 at step 182. At step 184 enforcement report 36 is stored in data storage module 24. After step 182 the process flows back to the entry point 170 whereby the entire process shown in FIG. 7 may commence again.

Figure 7B:
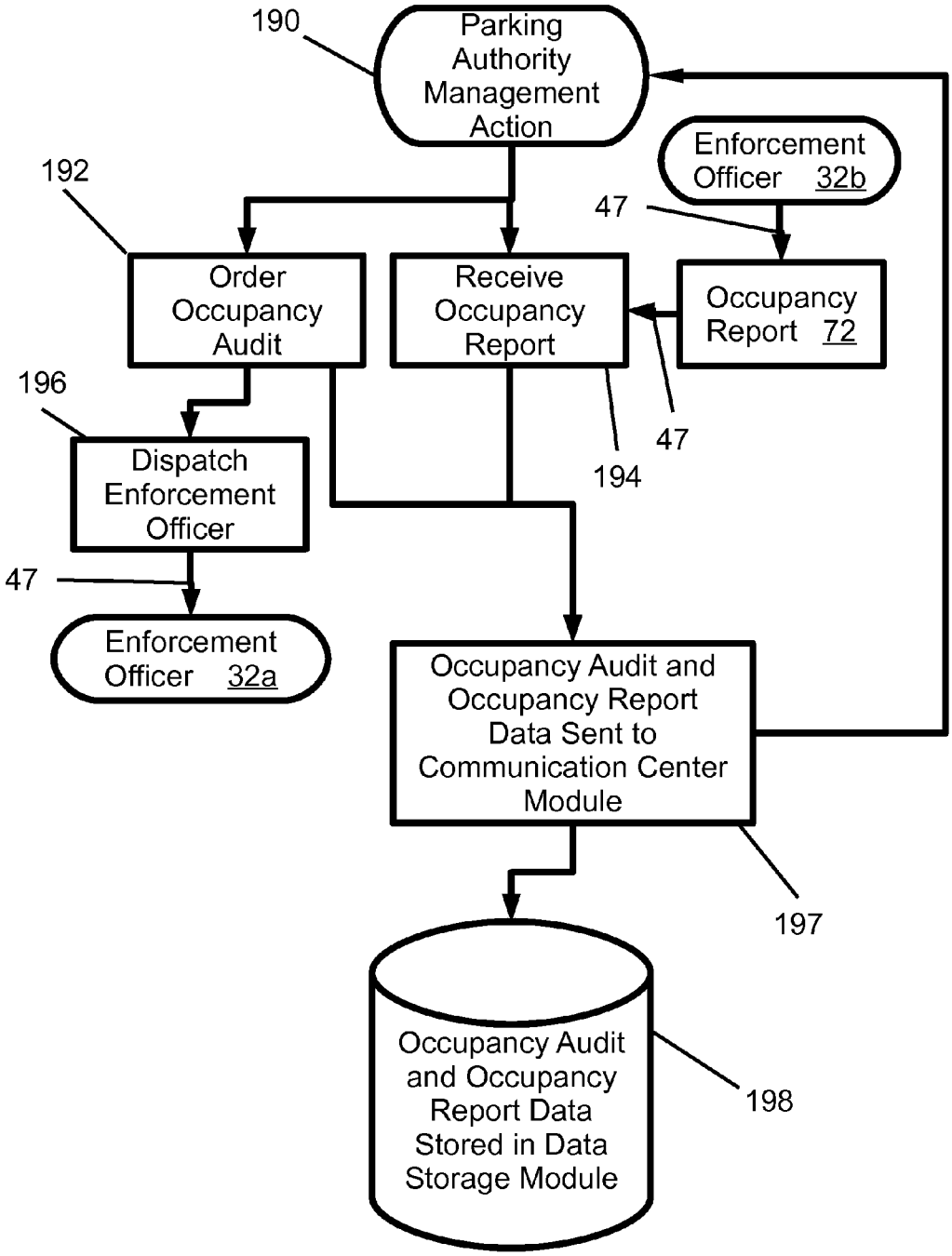
FIG. 7B shows a flow chart indicating parking unit occupancy related actions of a parking authority operating according to an embodiment of the present disclosure.

Turning now to FIG. 7B, there is shown a flow chart indicating occupancy actions of parking authority 30 operating according to an embodiment of the present disclosure. As indicated in FIG. 7B, parking authority 30 carries out occupancy related actions in addition to actions performed during parking facility setup and in addition to enforcement related actions. Step 190 is the entry point for the occupancy related actions of parking authority 30. An occupancy audit order is generated by parking authority 30 in step 192 wherein the intention of the occupancy audit is to determine the actual occupancy state of one or more parking units. Parking authority 30 responds to the occupancy audit order at step 196 by dispatching enforcement officer 32*a* to perform the audit. Dispatch of enforcement officer is communicated to enforcement officer 32*a* through seventh communication means 47. The occupancy audit order is also communicated through second communication means to communication center module at step 197. At step 198 occupancy audit order data is stored in data storage module 24. After step 197 the process flows back to the entry point 190 whereby the entire process shown in FIG. 7B may commence again.

Continuing with FIG. 7B, there is also shown step 194 in which parking authority 30 receives an occupancy report 72 from enforcement officer 32*b*. Occupancy report 72 contains information pertaining to the actual occupancy state of one or more parking units 12 audited by enforcement officer 32*b*. Occupancy report 72 is communicated to communication center module 22 at step 197. At step 198 occupancy report 72 is stored in data storage module 24. After step 197 the process flows back to the entry point 190 whereby the entire process shown in FIG. 7B may commence again.

Figure 8:
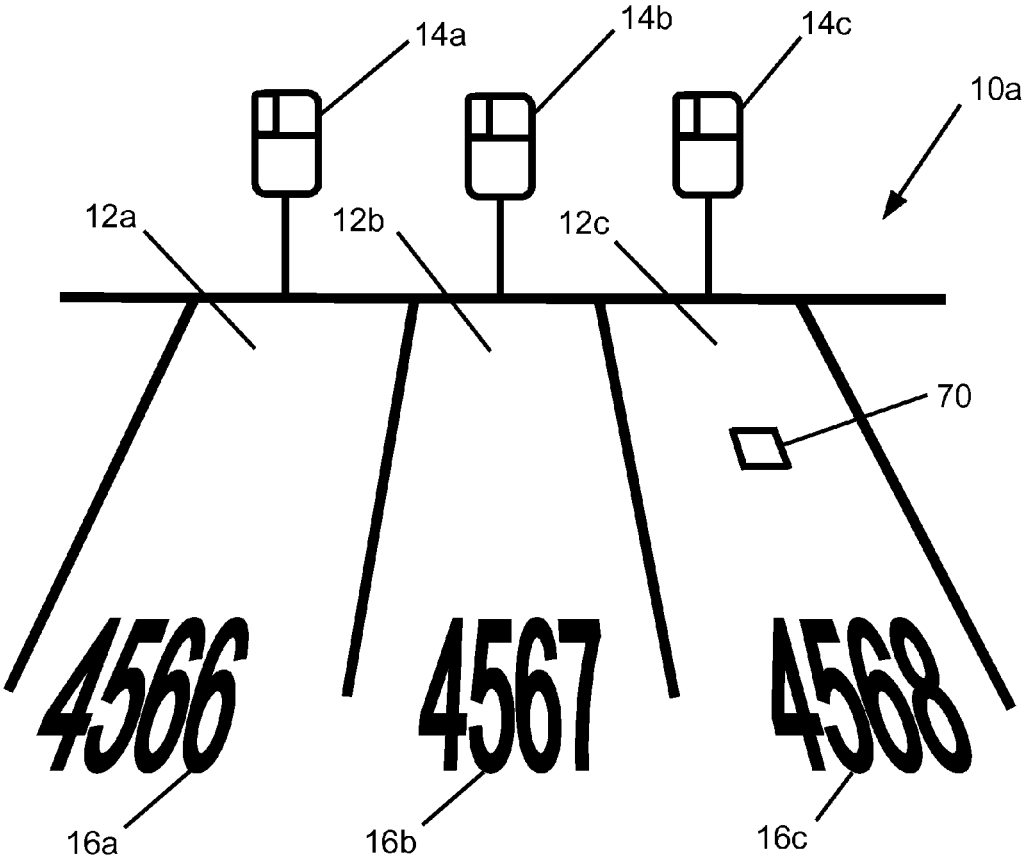
FIG. 8 shows a perspective view of a portion of a parking facility according to another embodiment of the present disclosure.
Figure 9:
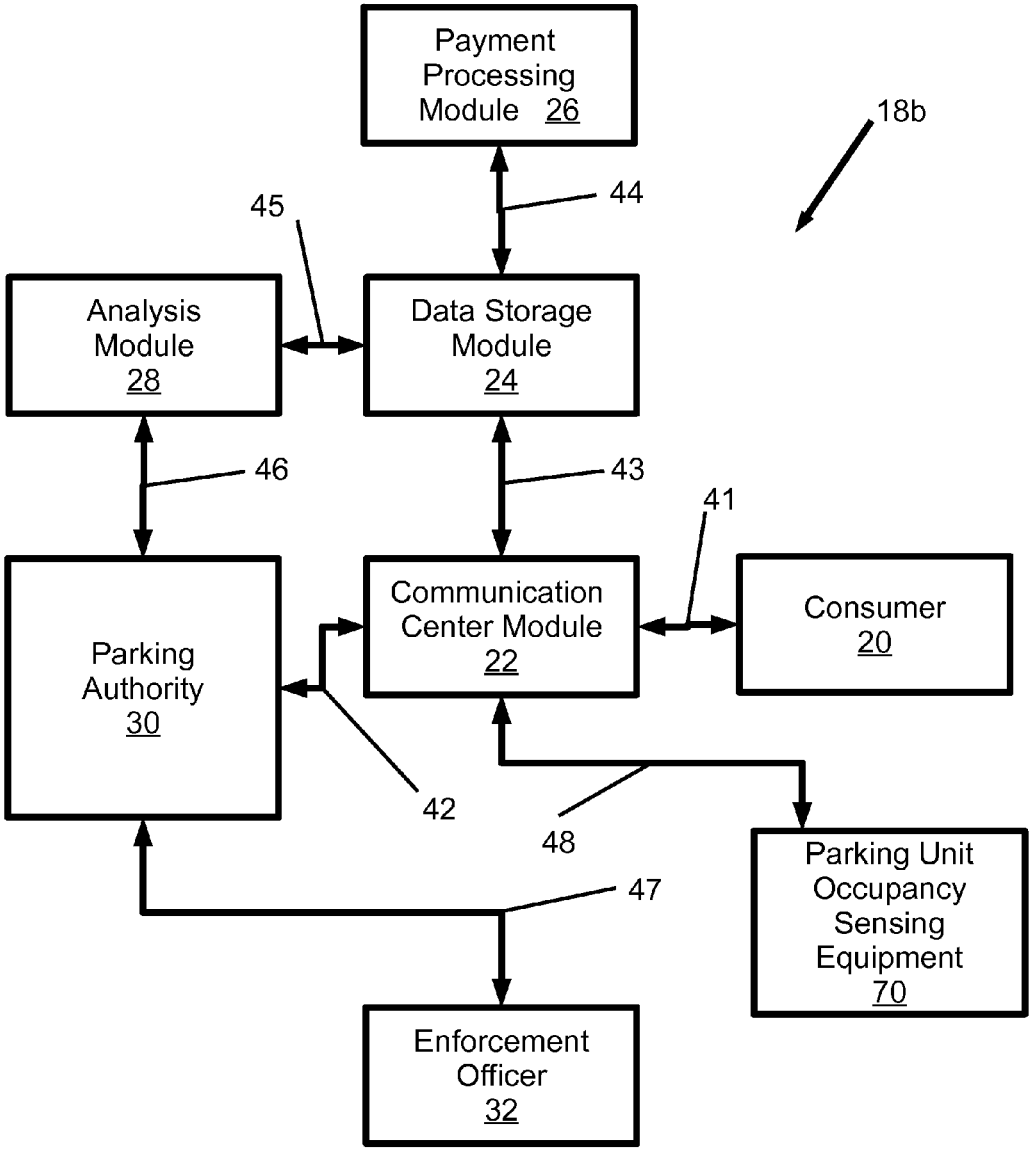
FIG. 9 shows a block diagram of an automated system for the parking of vehicles according to another embodiment of the present disclosure.

In another embodiment of an automated system for the parking of vehicles 18*b*, as depicted by the block diagram of FIG. 8, a parking unit may additionally comprise a parking unit occupancy sensing equipment 70 that is able to sense and communicate the occupancy state of the parking unit to which it pertains. Parking unit 12*c* of FIG. 9 is shown with parking unit occupancy sensing equipment 70 positioned to sense the occupancy state of parking unit 12*c* wherein two different states are detected: 1) occupied, and 2) not occupied. As indicated in FIG. 8, the state of occupancy of a parking unit so monitored may be communicated via suitable eighth communication means 48 to communication center module 22. Parking unit occupancy sensing equipment 70 is an optional module and is not required in preferred versions of an automated system for the parking of vehicles 18.

Any element in a claim that does not explicitly state "means for" performing a specified function, or "step for" performing a specific function, is not to be interpreted as a "means" or "step" clause as specified in 35 U.S.C. Section 112, Paragraph 6. In particular, the use of "step of" in the claims herein is not intended to invoke the provisions of 35 U.S.C. Section 112, Paragraph 6.

What is claimed is:

1. An automated system for managing a parking facility including a plurality of parking units suitable for the parking of a vehicle comprising:

a) a means for uniquely identifying each parking unit in said parking facility;

b) a first communication means;

c) a communication center module operably connected to said first communication means wherein said communication center module comprises a computer system including at least one processor, said communication center module operated by a first entity, the communication center module adapted to interact with a consumer and receive data from the consumer comprising:

i) consumer identity data, ii) parking unit identity data, and iii) consumer payment data;

d) a second communication means;

e) a parking authority operated by a second entity separate from the first entity, the parking authority adapted to interact with said communication center module through said second communication means to provide data comprising: preferred communication methods, identification information for each parking unit under management in said parking facility, predetermined parking facility use data, enforcement authorization, and parking violation threshold data;

f) a third communication means;

g) a fourth communication means;

h) a fifth communication means;

i) a data storage module comprising a computer system operated by said first entity, said data storage module adapted to interact with said communication center module through said third communication means, said data storage module further adapted to interact with a payment processing module through said fourth communication means, and said data storage module further adapted to interact with an analysis module through said fifth communication means; wherein the data storage module interactions with said communication center module, said payment processing module, and said analysis module comprise receiving, storing, retrieving, and sending data, said data comprising:

i) parking violation threshold data,
ii) predetermined parking facility use data,
iii) current parking facility use data,
iv) historical parking facility use data,
v) current consumer identity data,
vi) historical consumer identity data,
vii) current consumer payment data, and,
viii) historical consumer payment data,
ix) current enforcement report data,
x) historical enforcement report data;

j) said payment processing module comprising a computer system adapted to process a payment using data received from said data storage module and generate a payment transaction with said consumer as payor;

k) said analysis module comprising a computer system operated by said first entity, said analysis module adapted to analyze data from said data storage module, wherein at least one item of said data represents a current operational state, wherein the analysis module is adapted to use said current operational state to issue a first enforcement alert in response to detecting a potential parking violation of said parking facility;

l) a sixth communication means operably connected to said analysis module and to said parking authority and wherein said first enforcement alert is communicated to said parking authority via said sixth communication means;

m) a seventh communication means operably connected between said parking authority and at least one enforcement officer;

n) said parking authority adapted to:

i) receive said first enforcement alert, and generate a dispatch order for at least one enforcement officer based on said first enforcement alert, and communicate said dispatch order to said enforcement officer through communication means seven;

ii) produce a first enforcement report summarizing the actions taken and results obtained by said enforcement officer in the course of an enforcement officer response to said first enforcement alert, and, iii) communicate said first enforcement report to said communication center module through said second communication means.

2. The system of claim 1 wherein said parking unit identity data is located in close proximity to the parking unit to which it pertains, said parking unit identity data is in human readable form, and said parking unit identity data is positioned to be readable while the vehicle occupies the parking unit to which said parking unit identity data pertains.

3. The system of claim 2 additionally comprising: contact information indicating how said consumer is to initiate communication with said communication center module; said contact information further including said parking unit identity data, and wherein said communication center module is further adapted to receive data further comprising some of the contact information used by said consumer.

4. The system of claim 1 wherein the communication center module interaction with said consumer comprises a check-in interaction at the commencement of a parking period, wherein the parking period is an amount of time, and, wherein the time and date of said check-in interaction is stored in said data storage module.

5. The system of claim 1 wherein the communication center module interaction with said consumer comprises a check-out interaction at the termination of said parking period, wherein the parking period is an amount of time, and, wherein the time and date of said check-out interaction is stored in said data storage module.

6. The system of claim 1 wherein said consumer identity data comprises at least one item selected from a group consisting of consumer biometric data and consumer behavioral data.

7. The system of claim 6 wherein the communication center module is adapted to identity a mismatch between a first item of consumer identity data and a second item of consumer identity data, produce a second enforcement alert, and communicate said second enforcement alert to said parking authority through said second communication means, and wherein said parking authority is adapted to a) receive said second enforcement alert and dispatching at least one enforcement officer in response to said second enforcement alert, b) produce a second enforcement report summarizing the actions taken and results obtained by said enforcement officer's response to said second enforcement alert, and, c) communicate said second enforcement report to said communication center module through said second communication means.

8. The system of claim 1 wherein the communication center module is adapted to recognize previous consumers of the parking facility, identify consumers of the parking facility who provide faulty consumer payment data, produce a third enforcement alert, and, communicate said third enforcement alert to said parking authority, wherein said parking authority is further adapted to:

a) receive said third enforcement alert and dispatching at least one enforcement officer in response to said third enforcement alert.

9. The system of claim 1 additionally comprising an eighth communication means, and additionally comprising at least one parking unit that comprises parking unit occupancy sensing equipment, and wherein said occupancy sensing equipment is adapted to communicate an occupancy state of said parking unit through said eighth communication means to said communication center module.

10. The system of claim 1 wherein said parking authority is further adapted to:

a) dispatch said enforcement officer to audit the actual occupancy state of at least one or more of said parking units though said seventh communication means, b) produce an occupancy report summarizing the occupancy state of one more parking units, c) communicate said occupancy report to said communication center module through said second communication means.

11. A method of managing a parking facility via computer processor comprising the steps of:

a) receiving, by a communication center module using a processor operated by a first entity, consumer data from a consumer of said parking facility, said consumer data comprising: consumer identity data, parking unit identity data, and consumer payment data;

b) storing said consumer data received from said consumer in a data storage module operated by said first entity;

c) processing payments from said consumer of said parking facility;

d) receiving, by said communication center module, parking facility controlling parameters from a parking authority operated by a second entity separate from said first entity, wherein said parking facility controlling parameters comprise: preferred communication methods, identification information for each parking unit under management in said parking facility, predetermined parking facility use data, and parking violation threshold data;

e) analyzing, by an analysis module using a computer processor operated by said first entity, a set of data, wherein said set of data comprises: a current operational state, said predetermined parking facility use data, and, said parking violation threshold data, wherein at least one item of the data stored in said data storage module represents the current operational state;

f) detecting, by said analysis module, a potential parking violation;

g) generating, by said analysis module, a first enforcement alert based on the detection of the potential parking violation;

h) communicating, by said analysis module, said first enforcement alert to said parking authority;

i) generating, by said parking authority, a dispatch order for parking enforcement;

j) communicating, by said parking authority, said dispatch order to a parking enforcement.

12. The method of claim 11 wherein the step of receiving consumer data further comprises receiving consumer identity data comprising at least one item from a group consisting of consumer biometric data and consumer behavioral data, the method additionally comprising the steps of:

a) comparing said consumer identity data with data stored in said data storage module;

b) detecting a difference between said consumer identity data and data stored in said data storage module;

c) generating, by a computer processor, a second enforcement alert based on said difference;

d) communicating said second enforcement alert to said parking authority;

e) generating a dispatch order for parking enforcement.

13. The method of claim 11 further comprising the steps of:

a) receiving enforcement report data from said parking authority, and b) storing enforcement report data in said data storage module.

14. The method of claim 11 wherein said step of receiving consumer data further comprises:

a) a first communication with said consumer, and b) a second communication with said consumer.

15. The method of claim 11 additionally comprising the steps of:

a) recognizing previous consumers of said parking facility;

b) detecting consumers who provide faulty consumer payment data;

c) generating, by a computer processor, a third enforcement alert based on detection of said faulty consumer payment data;

d) communicating said third enforcement alert to said parking authority; and, e) generating a dispatch order for parking enforcement.

16. The method of claim 11 further comprising the step of:

a) adjusting the predetermined parking facility use data using data acquired through operation of said parking facility, wherein the data used for adjusting comprises at least one item of data from the group consisting of:

i) parking violation threshold data, ii) current parking facility use data, iii) historical parking facility use data, iv) current consumer identity data, v) historical consumer identity data, vi) current consumer payment data, vii) historical consumer payment data, viii) current enforcement report data, and, ix) historical enforcement report data.

17. The method of claim 16 further comprising the step of:

a) adjusting the parking violation threshold data using data acquired through operation of said parking facility, wherein the data used for adjusting comprises at least one item of data from the group consisting of:

i) predetermined parking facility use data, ii) current parking facility use data, iii) historical parking facility use data, iv) current consumer identity data, v) historical consumer identity data, vi) current consumer payment data, vii) historical consumer payment data, viii) current enforcement report data, and, ix) historical enforcement report data.

18. The method of claim 11 further comprising the steps of:

a) using, by the consumer, contact information to communicate with the communication center module, said contact information additionally comprising parking unit identity data; and b) receiving, by said communication center module, data comprising at least some of the contact information used by the consumer.

* * * * *